United States Patent [19]

Griffith et al.

[11] 4,017,034

[45] Apr. 12, 1977

[54] ART OF DRY MILLING SORGHUM AND OTHER CEREAL GRAINS

[75] Inventors: Edwin Griffith, Dodge City, Kans.; Edward S. Stickley, Milwaukee, Wis.

[73] Assignee: Krause Milling Company, Milwaukee, Wis.

[22] Filed: Apr. 12, 1976

[21] Appl. No.: 676,017

[52] U.S. Cl. ..... 241/74; 241/88; 241/89.2

[51] Int. Cl.[2] ..... B02C 13/09

[58] Field of Search ..... 241/49, 51, 55, 74, 241/87.1, 88, 89.2

[56] References Cited

UNITED STATES PATENTS

| | | | |
|---|---|---|---|
| 2,873,920 | 2/1959 | Holm | 241/74 |
| 3,423,031 | 1/1969 | Merges et al. | 241/49 |
| 3,726,208 | 4/1973 | Brengman et al. | 241/74 |
| 3,756,517 | 9/1973 | Hoch et al. | 241/74 |

*Primary Examiner*—Granville Y. Custer, Jr.
*Attorney, Agent, or Firm*—Wheeler, Morsell, House & Fuller

[57] ABSTRACT

Properly tempered sorghum or other cereal grain is continuously metered by an auger in an axial direction into the center of the interior of a rotor where it is acted on by a flared textured cone to cause discharge into an independently rotating spreader having vanes which assure uniform distribution of the grain along the entire length of the interior of the rotor. The interior of the peripheral wall of the rotor has circumferentially-spaced axially-extending elements which guide the grain toward axial slots in the peripheral wall and which lead to a peripheral space between the rotor and a perforated stator wall where the grain is acted on by axial bars to promote cleavage of the grain and perform concomitant decortication and degermination, converting the endosperm tissues into particles of a desirable size and shape, free from attached seedcoat and germ tissues so that said particles are thereafter readily separable by known milling methods.

16 Claims, 10 Drawing Figures

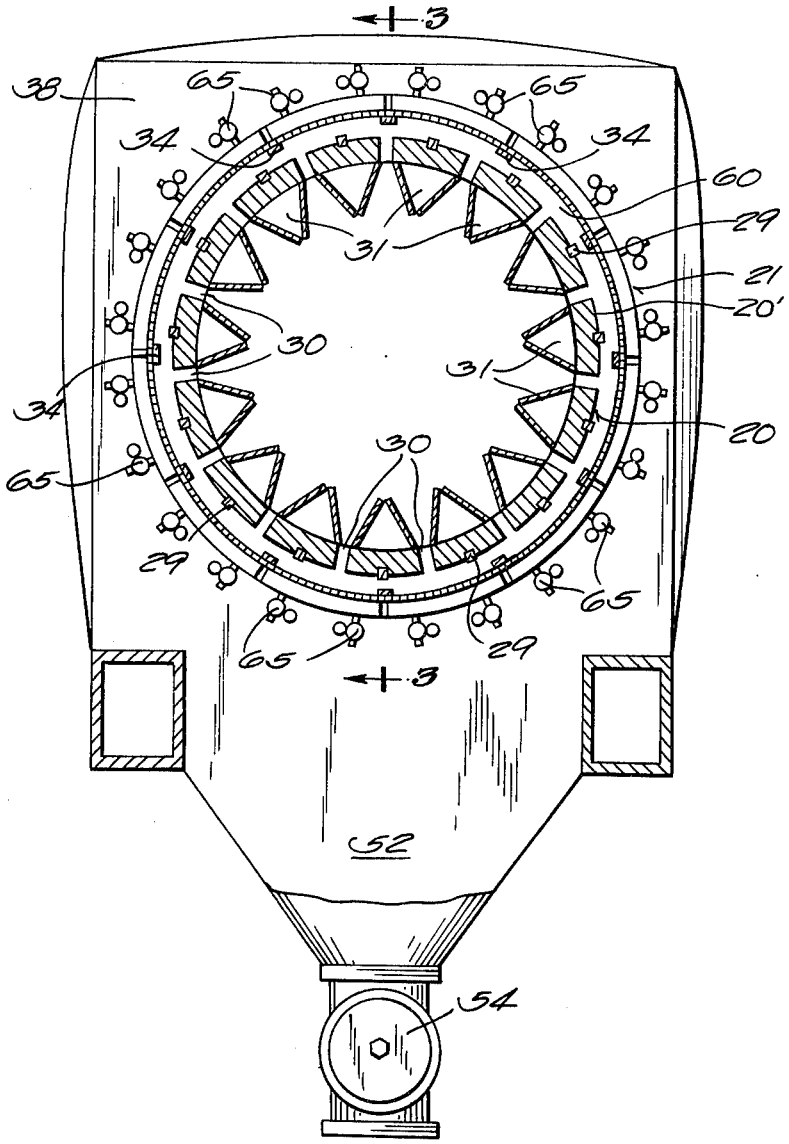
Fig. 2.
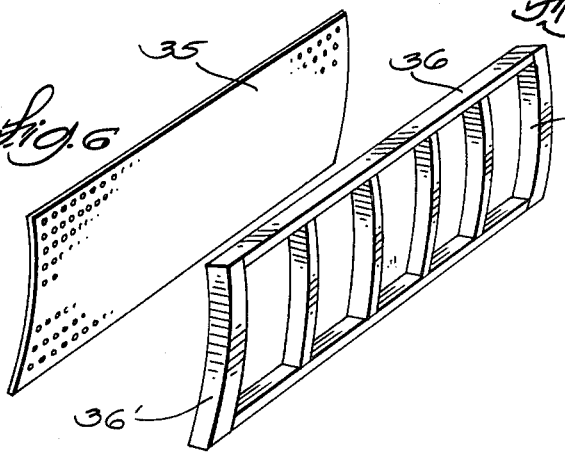
Fig. 5
Fig. 6

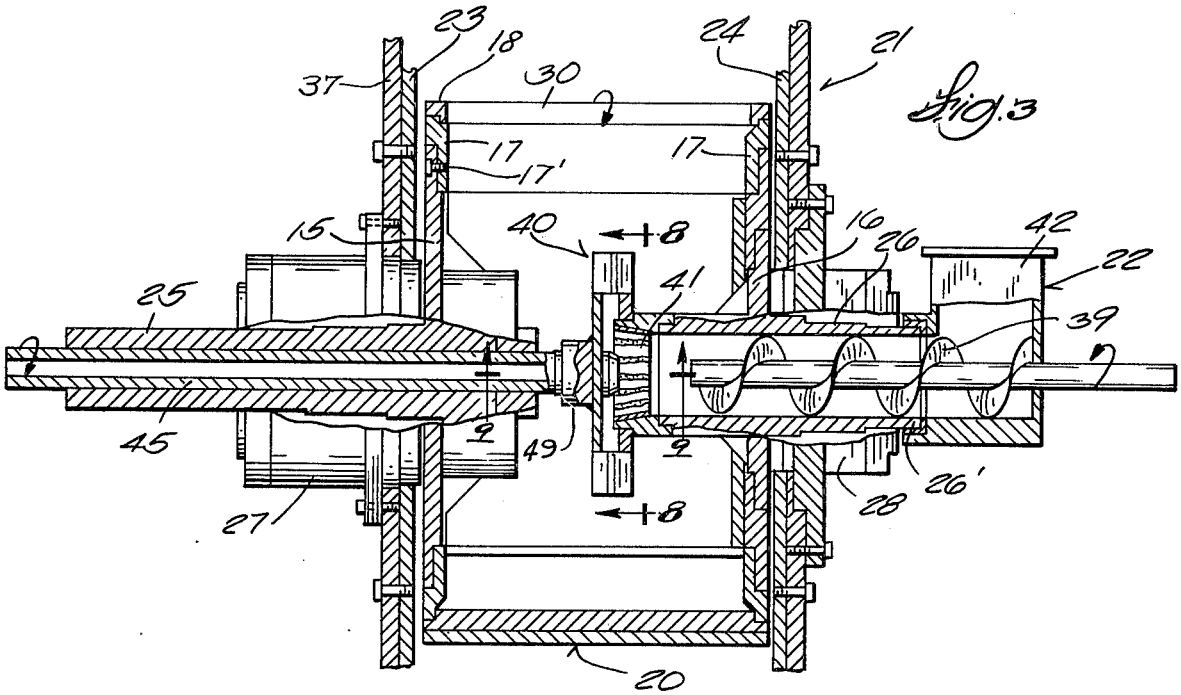
Fig. 3
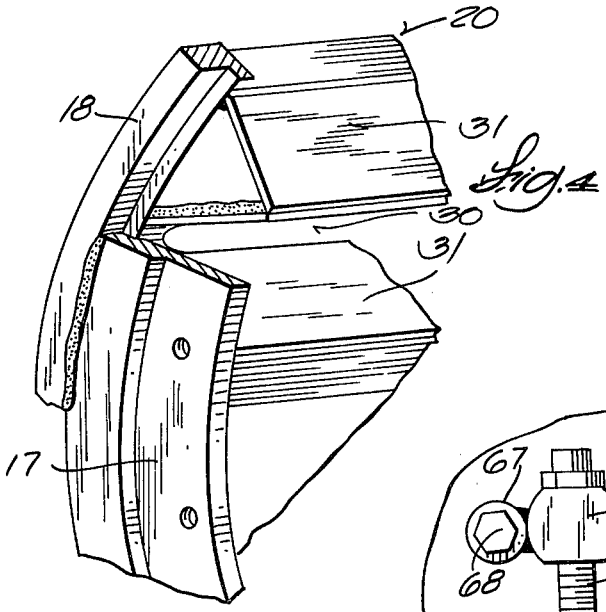
Fig. 4
Fig. 7
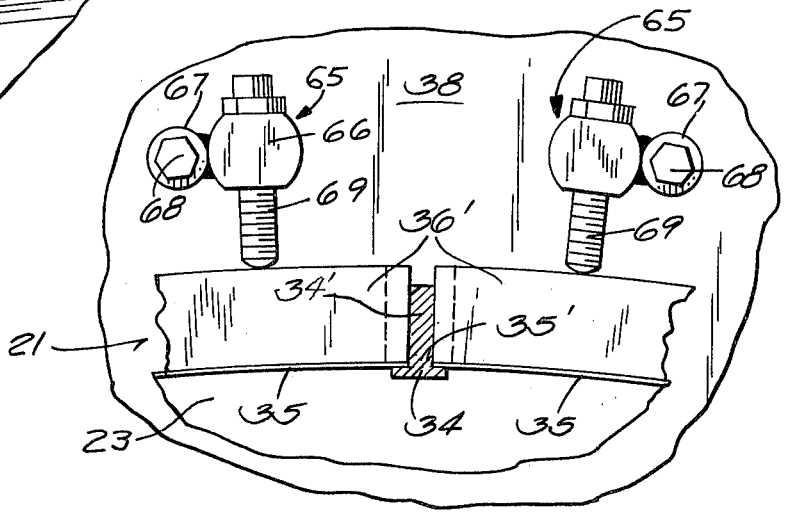

ART OF DRY MILLING SORGHUM AND OTHER CEREAL GRAINS

BACKGROUND OF THE INVENTION

The present invention relates to new and useful improvements in the dry milling of sorghum grain and other cereal grains. More particularly, the invention relates to decortication and degermination of grains for the purpose of deriving therefrom coarse particles of refined endosperm, commonly known as grits.

It will be understood that cereal dry milling, within the context of this disclosure, is the practice of operating upon a cereal grain in such a manner as to fractionate it essentially in acccordance with its three major component tissues for the primary purpose of producing therefrom useful products of high starch content but low lipid and fiber contents. Said component tissues are commonly known as seadcoat, germ and endosperm. The seedcoat tissue is of high fiber content and also has a significant proportion of lipids. The germ contains the major portion of the lipids of the whole grain, and it also has the highest protein content of all tissues. The endosperm is comprised largely of starch, and has a moderate proportion of protein and only minor amount of lipids. The objectives of the milling process is therefore to produce maximum yields of refined endosperm particles with minimal amounts of seedcoat and germ tissues in adherence to or in admixture with said endosperm. The grain, throughout the milling process, is usually held in the dry state. This description is known to be unspecific as to the moisture content of the grain and only to imply that no free or unsorbed water is present. Thus, the grain may be processed at its inherent or equilibrium moisture level; or a preliminary tempering or conditioning process may be applied to increase the moisture content of the grain and to establish therein a preferred distribution of the added water among the cereal tissues for the purpose of assisting in the detachment of the tissues.

Commercial dry milling of sorghum grain is conducted generally by two known processes. One process comprises the succession of individual operations described as follows: (1) decortication, or removal of seedcoat tissues, by pearling, polishing or various other forms of abrasion or impact; (2) removal of loosened seedcoat tissue by aspiration; (3) degermination, or cleavage of the pearled grain so as to fracture the endosperm and detach the germ therefrom, thus producing a mixture of endosperm and germ particles; and (4) resolution of said mixture by a combination of processes of sifting, aspiration and gravity separation to remove the germ and accumulated fine particles and thereby produce refined particles of endosperm as the prime product. Prior to this sequence of operations, the sorghum grain may be tempered or conditioned to a limited extent to assist in removal of seedcoat tissue. The second known process is an adaptation of the common roller-mill process for milling of wheat to produce refined flour products. The sorghum grain is conditioned to higher moisture levels and for relatively longer periods of time to effect loosening of seedcoat tissue and to soften the germ, and is then reduced by an elaborate progression of roller-mill, aspiration, sifting and purifying operations. The basis principles in regard to separation of the several cereal tissues in this gradual reduction process are that endosperm will be ground to relatively small granular particles which will pass through the finer mesh screens of sifters, whereas the germ will be flattened with only moderate extent of comminution and will pass over said finer screens, and the light and flaky seedcoat tissue will pass over coarser screens in admixture with partially reduced particles of the more dense tissues and be lifted therefrom by aspirators or purifiers. The refined endosperm is thus recovered in the form of small particles such as meals and flour, in contrast to the larger particles, or grits, obtained from the milling process first described.

Degerminators for use with grain sorghum have heretofore been used experimentally. These devices have consisted of a cylindrical wire brush rotating within a perforated cylinder, the grain being fed directly into the peripheral space between the brush and cylinder. Such a device is described in the 1965 issue of "American Miller and Processor". A similar device which has been used experimentally substitutes a cylinder having ribs or bars for the wire brush. These devices have a very low capacity, and the wire brush type is very impractical as the bristles soon wear off and are likely to break and leave wire particles in the product mix. Furthermore, none of the prior devices distribute the grain uniformly in the operating space, with the result that production rate is limited and no means is provided to assure uniform treatment of the individual grains, with undesirable effects such that the subsequent separation steps are rendered more complicated and expensive. In none of these prior devices is the grain fed into the interior of a hollow rotor and spread and uniformly distributed therein before it is discharged into a peripheral space where decortication and degermination is to take place.

Patents with which applicants are familiar are as follows: U.S. Pat. Nos. 3,885,464 May 27, 1975; 3,703,200 Nov. 21, 1972; 3,734,752 May 22, 1973; 2,108,655 Feb. 15, 1938; 3,603,365 Sept. 7, 1971; 3,222,183 Dec. 7, 1965; 3,498,796 Mar. 3, 1970. While these patents relate to broadly similar objectives, the subject matter of the claims of the present invention is not disclosed or suggested therein. In U.S. Pat. No. 3,885,464 the grain is inserted at one end of a cylinder and removed from the other end after being acted on by spaced disc-like polishing stones. In U.S. Pat. No. 3,703,200 the grain is fed to a gap between the end face of a rotor and the adjacent end of the casing. The grain is not fed to the interior of the rotor to be discharged from rotor openings. U.S. Pat. Nos. 3,734,752; 2,108,655; and 3,603,365 all have conical degerminating rolls and there is no hollow rotor into which grain is fed to be discharged from peripheral openings into a milling space. U.S. Pat. No. 3,222,183 discloses no apparatus and merely suggests the use of conventional scourers, hullers, decorticating apparatus or brushes. U.S. Pat. No. 3,498,796 relates to a heat and moisture treatment prior to being acted on by a conventional roller mill.

SUMMARY OF THE INVENTION

The present invention is used in milling apparatus wherein there is an outer housing with a cylindrical stator supported in said outer housing, said stator having a perforated peripheral wall and there being an outer space between said outer housing and stator from which grain particles are to be discharged. The apparatus also has a rotor and has means supporting the rotor for rotation within the stator, there being a milling space between the rotor and stator and there being cooperating means on the interior of the peripheral wall of the stator and the exterior of the rotor for performing concomitant decortication and degermination in said milling space. In the improvement provided by the present apparatus, the rotor is hollow and is provided with openings in its periphery communicating with the milling space, and there is means for feeding grain into the interior of the hollow rotor for efficient discharge from the rotor openings substantially throughout the length of the interior of the rotor into said milling space.

One object of the invention is to provide a practical commercial device for concomitant decortication and degermination of grains, thus accomplishing in a single operation the functions commonly carried out by a series of successive and separate operations.

Another object of the invention is the provision of an apparatus that decorticates and degerminates concomitantly in such a manner as to render the detached cereal tissues easily separable by simple and known means, there being means for introducing the grain into the interior of a hollow rotor and for spreading and distributing it in said interior before it is discharged into the decortication and degermination space between the rotor and a stator.

Another object of the invention is a device embodying concomitant decortication and degermination which is applicable to grains that have been conditioned by treatment with water, with or without other added substances, to improve detachment of the several cereal tissues.

A still further object of the invention is a device providing a novel treatment of sorghum and other cereal grains that have been conditioned preliminarily with water to increase total moisture content and to establish a preferred distribution of moisture among the cereal tissues therein and that are yet in the dry state, said manner of treatment resulting in reduction of the grains to an admixture of fragmented and detached tissues from which beneficial yields of decorticated and degerminated endosperm particles of propitious granulation and refinement can be obtained by the use of simple known mechanism.

A more specific object of the invention is to provide a novel apparatus for treating grain wherein the grain is first fed axially into the interior of a rotor while the latter is rotating, is spread and distributed within said interior to assure uniform distribution of the grain along the entire length of the rotor, is impelled radially from openings in the periphery of the rotor into a peripheral space between the exterior of the rotor and the interior of a stator, and decortication and degermination takes place in said peripheral space to convert the endosperm tissues into particles of a desirable size and shape, free from attached seedcoat and germ tissues, so that said particles are readily separable by relatively simple known milling procedures.

BRIEF DESCRIPTION OF THE DRAWINGS

FIG. 2 is a sectional view of the apparatus taken along line 2—2 of FIG. 1.

FIG. 3 is an enlarged view principally in section taken along line 3—3 of FIG. 2, parts being shown in full.

FIG. 4 is an enlarged fragmentary perspective view taken along line 4—4 of FIG. 1, part of an end rotor ring being shown.

FIG. 5 is an enlarged perspective view of a stator frame section.

FIG. 6 is a perspective view of a perforated screen section for use with the frame of FIG. 5.

FIG. 7 is an enlarged fragmentary elevational view showing two of the stator frame clamps and fragments of associated parts as is also illustrated in FIG. 2.

DESCRIPTION OF THE PREFERRED EMBODIMENT

Figure 1:
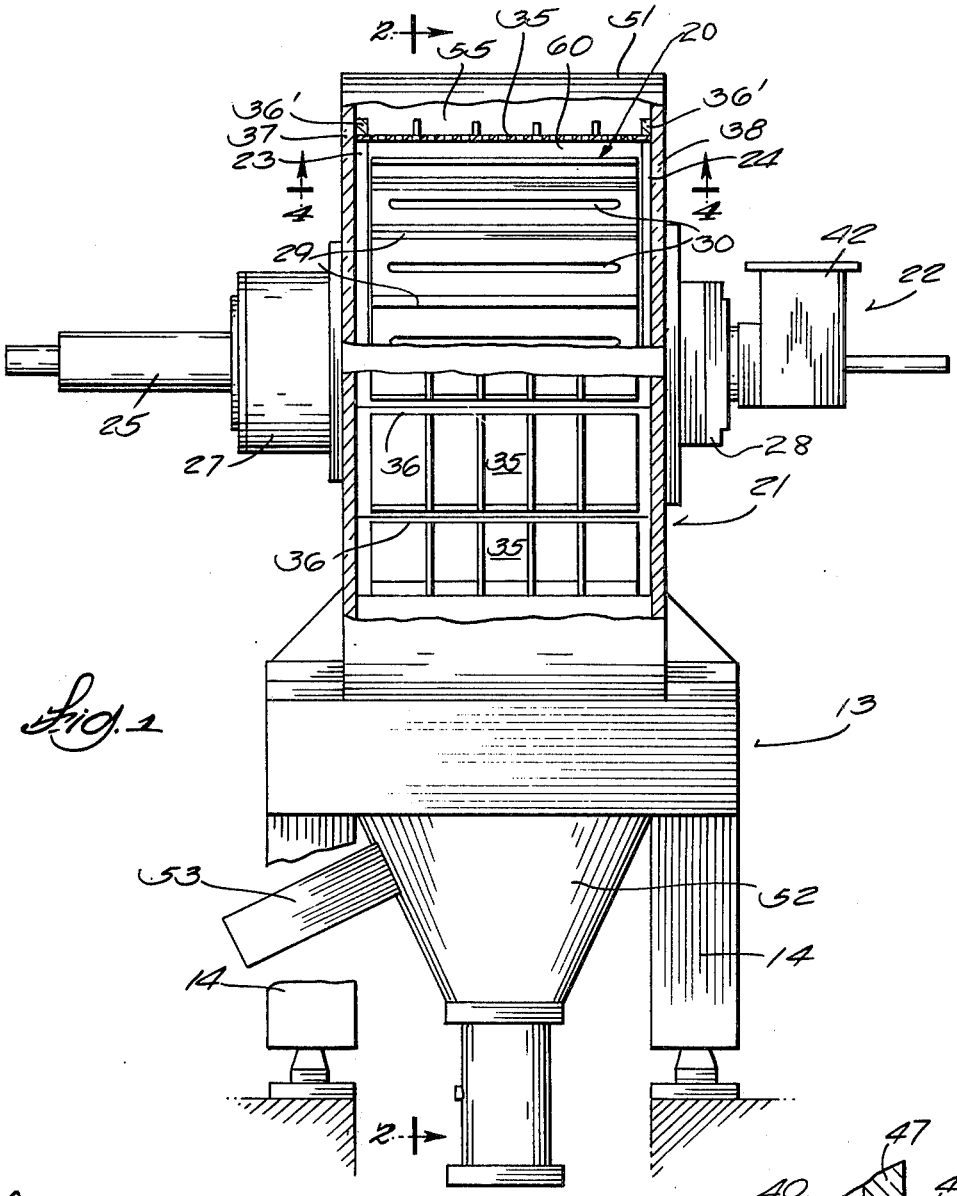
FIG. 1 is a side elevation of an apparatus constructed in accordance with one preferred embodiment of the invention, parts being broken away and shown in section.

In accordance with the invention, an apparatus is provided for a novel manner of treatment of grains, said apparatus deriving its beneficial functional characteristics from the construction and the manner of assemblage of three primary mechanical components.

Referring to the drawing, the apparatus for treatment of grain is mounted on a suitable stand 13 which also supports and provides means of alignment for all accessory elements including a main reversible drive motor (not shown), motors and drives for separately powered elements, and appurtenant controls and guards. The stand is supported by six vertical columns 14 terminating with base pads and may be mounted on a floor or other suitable structure. The heavy rectangular end plates 37 and 38 on the drive and tail ends of the apparatus, respectively, are mounted and aligned upon the stand 13 by suitable brackets. The drive-end bearing housing 27 is flange-mounted to the drive end plate 37 by suitable bolts fitting into threads tapped into the end plate. Similarly, the tail-end bearing housing 28 is flange-mounted to the tail end plate by suitable bolts fitting into threads tapped into this end plate. The stator support rings 23 and 24 on the drive and tail ends, respectively, are fastened to the corresponding end plates by suitable flathead bolts fitting into threads tapped into the end plates.

The three primary components of the preferred apparatus illustrated are a cylindrical rotor 20 of hollow construction, a coaxial cylindrical stator 21 having an inner diameter only moderately greater than the outer diameter of the rotor, and a feed mechanism 22 whereby a metered flow of grain is passed into the interior of the rotor and is impelled radially therefrom through slots 30 leading from the interior to the exterior of the rotor and thus introduced into the circumferentially confined region 60 between the exterior surface of the rotor and the interior surface of the stator.

Referring to FIGS. 1–3, the hollow rotor 20, mounted on a horizontal axis, consists of a cylindrical shell closed at the ends by combinations of parts including end discs 15 and 16, said discs 15 and 16 being supported by the two individual hollow coaxial shafts 25 and 26 which rotatably support the rotor and further provide means for the introduction of grain into the rotor interior and for rotatably supporting the interior feeding mechanism. The shaft 25 is journalled in a bearing assembly 27 and the shaft 26 in a bearing assembly 28.

The peripheries of the rotor discs 15 and 16 are notched to interfit with end rings 17 and are bolted thereto as shown in FIG. 3 by the use of bolts 17'. The end rings are welded or otherwise secured to the ends of the guide members 31. The outer peripheries of the end rings 17 are in turn notched to interfit with end peripheral rings 18 of the rotor, as also shown in FIG. 4. The external peripheral cylindrical surface 20' of the rotor is interrupted by a plurality of radially and equidistantly spaced outwardly projecting rectangular bars 29 (FIG. 2) affixed longitudinally and axially of said surface and extending continuously over essentially the full length thereof; and said surface 20' is further modified by the same number of circumferentially spaced rectangular openings or slots 30 penetrating radially through the rotor shell and into the interior cavity of the rotor, said slots extending continuously for the full interior length thereof, and being positioned equidistantly between the adjacent pairs of the rectangular bars 29. In the preferred embodiment, the bars 29 on the rotor are ½ × ½ × 18 inches (15 in number), and the keyways in the rotor shell into which the bars fit are 0.501/0.500 inch wide and 0.200 inch deep. Thus these bars project 0.300 inch from the surface of the rotor shell. The O.D. of the rotor shell is 27.75 inches and the O.D. of the stator rings is 28.90 inches. Thus the milling chamber 60 between cylindrical surfaces of the stator and rotor has a radial depth of 0.575 inch. With the rotor bars projecting outwardly by 0.300 inch and the stator bars projecting inwardly by 0.125 inch, the radial clearance between the rotating and stationary bars thus becomes 0.150 inch. The preferred stator screen perforations for milling of sorghum grain are 7/64 or 0.109 inch diameter round perforations.

The internal cylindrical surface of the rotor shell is fitted with a plurality of inwardly projecting guiding members 31 of triangular cross-section extending axially of the shell the full length thereof and being closed at each end by being welded or otherwise secured to the end rings 17, the base of each said member being a segment of said cylindrical surface defined by the closer edges of two adjacent slots 30 through the shell, these members 31 serving the multiple purposes of guiding the grain through the slots 30 in the shell, strengthening the shell segments and providing the means for fastening of the rotor end rings to the shell.

The stator 21 consists of a cylindrical perforated mantle interrupted on its inner surface by a plurality of circumferentially equidistantly spaced inwardly projecting rectangular bars 34 (FIG. 2) affixed longitudinally and axially of the inner surface of the stator and extendng continuously the full length thereof, said stator, for purposes of achieving adequate structural stability, being of segmented construction and composed of a plurality of arcuate segments 35 (FIG. 7) of perforated metal supported by frames 36 (FIG. 5). Each bar 34 has its width overlapping the linear edges of two adjacent perforated segments 35, as shown in FIG. 7, each such segment being supported exteriorly by a frame 36, and the latter being supported between the two structural end plate assemblies 37 and 38 of the device, as shown in FIG. 1, this manner of construction thereby providing common means of support and alignment for the stator, rotor and feeding mechanism by said end plate assemblies 37 and 38. The ends of the bars 34 are suitably connected to the stator support rings 23 and 24, and the bars having radial extensions 34' fitting between frames as shown in FIG. 7 to render the bars T-shaped in cross-section.

Each frame 36 has end members 36'. A series of screw clamps 65, two for each end member 36', surround the stator. Each clamp (FIG. 7) has a main body 66 with an extension 67 for receiving a bolt 68, by which the clamp is supported on one of the end plates 37 and 38. A clamping screw 69 which is threaded through the body 66 is adapted to bear against an end member 36' of a frame 36 to act in conjunction with other clamping screws in removably maintaining the frame against the periphery of the segments 35 as shown in FIG. 2. Thus these frames 36 together with the screen segments 35 may be readily removed for cleaning or replacement. In the preferred embodiment, the frames 36 have an arc of 28.87° each, and there are 12 frames and 12 screen segments; also, therefore 12 bars 34. Thus the gaps 35' between screens 35 are 1.13 degrees each. The bars 34 are ¾ × ⅛ inch in dimension. The screen segments 35 are 30° arc, but calculated on a radius slightly less than that of the frames 36 The stator bars are Ts with the bar parts 34 having ends suitably connected to the stator rings 23 and 24. The stem portion 34' of each T fills the gap 35' as shown in FIG. 7 so that all parts of the stator assembly are interlocked to become a rigid unit when the screw clamps 65 are tightened against the frame end members 36'.

Figure 9:
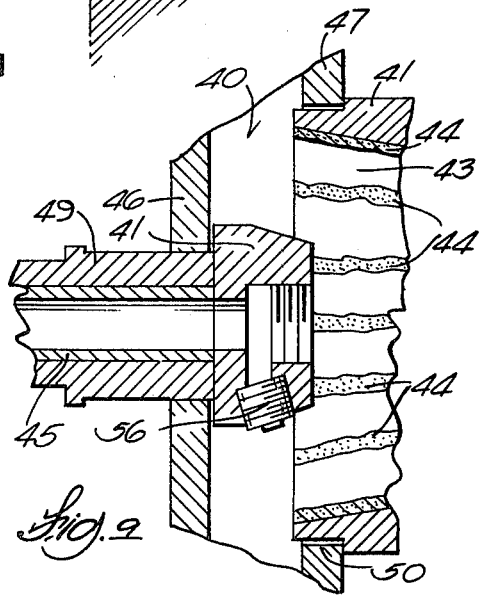
FIG. 9 is a fragmentary sectional view taken along line 9—9 of FIG. 3 and showing the position of the water spray head.

The feed mechanism 22 is a combination of two individual and cooperating elements. One element 40 is a rotating member positioned within the interior of the hollow rotor and mounted on the drive shaft 45. The latter is rotatably supported within and projects outwardly from the hollow rotor shaft 25, said drive shaft 45 being provided with its own driving means (not shown). The other cooperating element includes a feed screw 39 which operates inside of a feed tube 26, the latter having a nose cone 41 (see FIGS. 3 and 9), and the feed tube rotates with the rotor 20. There is a vertical rectangular grain inlet hopper 42 communicating with the feed tube. The hopper is mounted exteriorly of the apparatus and has an opening abutting coaxially at a rotary joint 26' with the outer end of the feed tube 26. The feed tube 26 also serves as the rotor tail shaft. The feed Screw is disposed partially within the hopper 42, but with its drive shaft projecting exteriorly therefrom and with its screw section extending within the bore of the rotor tail shaft 26 for the greater part of the length of said shaft. The feed tube is thus comprised of the bore of the tail shaft 26, and the nose cone 41, attached as a coaxial extension of the internal end of the rotor tail shaft 26, has a textured inner frusto-conical surface 43 with the minor diameter at the locus of attachment to the tail shaft and equivalent to the bore of said shaft, and with the terminus projecting into the coaxial grain inlet of the spreader 40. The textured surface 43 includes strips 44 of welding beads or the equivalent (FIG. 9).

Figure 8:
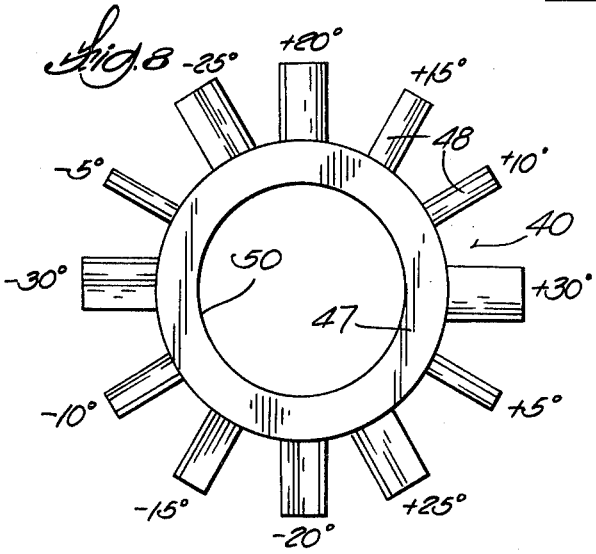
FIG. 8 is an end view of the spreader alone as viewed along line 8—8 of FIG. 3.

The spreader element 40 is of the form of a rotary vane impeller, positioned coaxially within the rotor and centrally of the length thereof, and supported by the inner end of a hollow drive shaft 45 extending rotatably through the bore of the rotor drive shaft 25, said spreader being constructed of two parallel and coaxial end rings 46 and 47 (see FIG. 9) of the same peripheral diameter separated by a distance approximately one-sixth of said diameter, and of a plurality of rectangular vanes 48 external to the rings and bridging the peripheral cylindrical ring surfaces, said vanes projecting outwardly and essentially radially from said ring surfaces for a distance approximately one-fourth of the ring diameter, and bridging the rings at various angles of inclination from the ring axis, as shown in FIG. 8, the end ring 46 having an axial bore and attached hub 49 for mounting to the spreader drive shaft 45, and the other having an axial bore 50 (see FIG. 9) rotatably accommodating the terminus of the nose cone 41.

Figure 10:
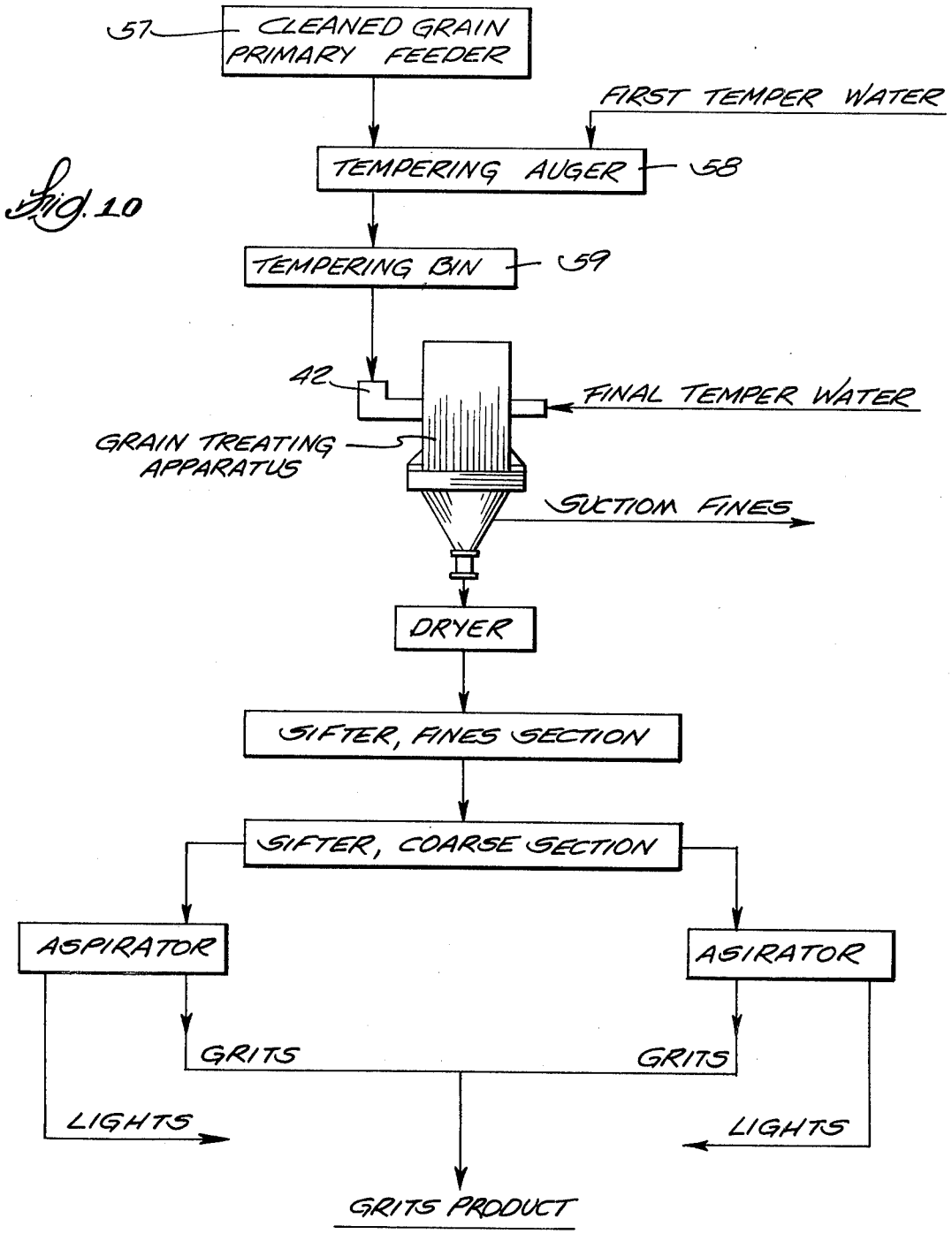
FIG. 10 is a flow diagram illustrating a preferred system utilizing the apparatus.

Other elements essential to the construction and operation of the apparatus are an outer housing comprised of the end plates 37 and 38 and a peripheral portion 51 (FIG. 1), suitable means for passage of air through the primary mechanical assembly and the housing, and means for application of a minor increment of water to the conditioned grain immediately prior to treatment within the device. The housing encloses the stator and projects downwardly from the horizontal plane of the axis of the apparatus, first as a rectangular duct, and then as a hoppered section 52 provided with an air outlet duct 53 near its upper terminus, and fitted to a rotary valve 54 at its lower terminus, said housing assembly serving to collect the grain fragments from the peripheral space 55 after their passage through the perforations of the stator, to discharge said fragments into means for conveying to a separation system as shown in FIG. 10, and also to maintain air pressure at other than atmospheric pressure within the housing. The passage of air is promoted and controlled by suction from the air outlet duct of the hopper, said air entering into the apparatus largely through the screw feeder 39 along with the grain and then sweeping through the rotor, into and through the confined region between rotor and stator wherein the grain is treated, through the perforations of the stator, into the region between stator and housing, and finally to the outlet duct. The water for final conditioning is added through the bore of the spreader drive shaft 45 and fitted terminally with pressure spray nozzles 56 (FIG. 9) so positioned as to direct sprays of water into the space between the two end rings of the spreader, thus moistening the grain surfaces just prior to treatment of the grain by the apparatus.

OPERATION OF THE APPARATUS

The apparatus is particularly useful for the concomitant decortication and degermination of sorghum grain because of the manner of cooperation of the primary and accessory mechanical components when conditions of operation are controlled such that a continuous supply of conditioned grain is provided at a rate properly in accord with the rate of rotation of the rotor, and a balanced flow of air is maintained through the primary assembly.

Cleaned grain at an appropriate uniform rate is supplied, as indicated by reference to FIG. 10, from a primary feeder 57, which may be selected from a number of known types, to a continuous-flow conditioning system comprised in one preferred embodiment of an auger 58 with interrupted flighting followed by a flow-through bin 59 in which a constant grain level is maintained, said combination of auger and bin being selected and controlled to allow a predetermined residence time of the grain therein for sorption of the water applied as a metered spray at the inlet end of the auger and, optionally, also at the outlet end of said auger. The conditioned grain from the tempering bin is transferred immediately to the hopper 42 leading to the screw feeder of the apparatus heretofore described in detail, and is then moved toward the interior of the rotor. It is understood from the drawing (FIG. 3) and previous description that the feed tube 26 of the screw feeder is the inner bore of the rotor tail shaft and that the nose cone 41 is an extension of said shaft internally of the rotor. Thus these two functional parts of the feeding mechanism rotate with the rotor in the direction indicated by arrows in FIG. 3. It is obvious that the feed screw, in order to promote the inward movement of the grain, must have a rotational differential with respect to the rotor shaft, and the manner of rotation preferred for this screw is directionally opposite to that of the rotor (as also shown in FIG. 3) and at a rate about one-half of the rotor rate.

The direction of rotation of the rotor and screw may be reversed from the direction shown in FIG. 3, in order to equalize wear on the parts, there being a reversing motor for the drive shaft 25. When this is done, however a interchangeable screw having reverse threading must be installed. The arrangement provides a possible feeding capacity of about 1.5 times the actual grain rate. Thus the feed from the screw 39 is operating under its capacity, allowing it to bring in air and allowing the grain to be loose and rolling. This assures that the grain will be propelled uniformly and without compaction. Rotary motion is thus imparted to the grain as it advances through the feed tube, and additional rotary impetus is provided by the expanding and textured inner surface 43–44 (FIG. 11) of the nose cone, causing the grain to become a fluidized mass swirling at nearly the rate of revolution of the rotor and expanding radially of the rotor as it passes into the interior of the spreader 40 and receives the final small increment of conditioning water from the spray nozzles 56 (usually three in number at 120° apart) protruding from the spreader hub. The spreader is rotated in the same direction as the rotor but at a higher rate of rotation such that the rotational velocity of the peripheral edges of the spreader vanes is similar to that of the inward edges of the prismatic guide members 31 appended to the rotor shell. Operated in this manner, the spreader provides further impetus to the movement of the grain and also provides direction of flow such that the grain is spread both radially and longitudinally of the rotor interior and is directed into the guides 31 in a fashion promoting continued movement through the slots 30 in the rotor shell. The grain, because of this manner of cooperation of the two feeding units, is subjected only to gentle impingements upon such members as the spreader vanes 48 and rotor guides 31 and passes radially of the rotor as a uniformly distributed flow of unbroken grains into the region 60 between rotor and stator. Within said region, and because of the manner of close confinement therein between an inner rotating cylindrical element with projecting bars 29 and an outer coaxial stationary element with projecting bars 34 and perforated screen segments, the mass of grain is subjected to stresses such as to promote controlled fracture of the individual grains and to create an admixture of fragmented and detached particles of the several cereal tissues. These fragments are then dispelled through the perforations in the screen segments of the stator and into the peripheral region between stator and outer housing. The controlled movement of air through the primary assembly of the apparatus, said air entering with the grain and exhausting through the air outlet 53 of the housing hopper, serves the several essential purposes of assisting in fluidizing of the grain internally of the rotor, of removing free moisture and fine dust generated during treatment of the grain, and of assisting the movement of the grain fragments through the perforations of the stator.

The grain fragments, as derived from this manner of treatment and as delivered from the rotary valve 54 at the lower terminus of the apparatus, require no further mechanical grinding or action and are a mixture of decorticated and degerminated endosperm particles, broken and partially abraded germ particles, and flakes of seedcoat tissue. These components are separable by a simple system combining sifting and aspiration, as illustrated in FIG. 10, to produce beneficial yields of the endosperm particles in the form of refined grits, largely in the range from 10- to 14-mesh size, with a smaller proportion ranging from 14 to 30 mesh size.

The preferred embodiment which has been described is suitable for the milling of sorghum, and the dimensional relationships set forth are those which are suitable for sorghum. It is to be understood, however, that the apparatus is suitable for the milling of other grains, and in such case the dimensional relationships may be changed by substituting bars of different dimensions on the rotor and by changing the dimensions of the perforations in the sectional stator screens.

The great advance in the art of dry milling of sorghum grain for production of refined grits realized by the application of the apparatus of this disclosure is illustrated by the following examples, Example 1 being a known procedure of the prior art and Example 2 being the present invention:

EXAMPLE 1

For the production of refined sorghum grits to be used as a food ingredient, commercial red-seeded sorghum grain grading as No. 2 yellow milo was fed to a grain cleaner at a rate of 5330 pounds per hour, and the cleaned grain was passed over a perforated metal screen having slotted openings of 0.098 inch width and 0.375 inch length to remove cracked and shrivelled grains and small foreign seeds. The cleaning and grading removed 8.0 percent, or 426 pounds per hour from the incoming grain. Thus the rate of cleaned and graded grain to the dry milling operation was 4904 pounds per hour.

The dry milling process employed was that which was described near the beginning of this specification in the discussion of the known art. The prepared grain at its inherent moisture content of 13.0% was decorticated in pearling machinery known to the art and having a row of corundum discs on a horizontal shaft rotating within a cylindrical mantle. The material discharged from the pearling operation was aspirated to remove seedcoat tissue and fines, and the heavier fraction, consisting of pearled grains and some cracked pearled grains, was degerminated by passage through a known form of impact cracking machinery wherein the incoming stock is thrown from a centric rotating distributor so as to impinge against the solid inner wall of a concentric mantle with such force as to cleave the endosperm and detach the germ. The admixture of endosperm and germ particles and fines discharged from the degermination operation was aspirated to remove the lighter material, and the heavier stock was separated in a sifter to give three fractions: (1) over 8-mesh; (2) between 8- and 40-mesh; and (3) thru 40-mesh. The coarse fraction was recycled to the degerminator, and the fine fraction was sent to a secondary recovery system for use in making products of less refinement for industrial usage. The intermediate fraction, comprised of a mixture of endosperm and germ particles, was sent to a second sifter for separation into four fractions: (1) over 12-mesh; (2) between 12- and 14-mesh; (3) between 14- and 30-mesh; and (4) thru 30-mesh. The three coarser fractions were sent to three individual gravity separators, each adjusted to separate the germ and endosperm from a feedstock of limited granulation range. The fine fraction was sent to the secondary recovery system along with the fines from the first sifter and other fines generated during the decortication and degermination operations. A recleaned portion of the cracked grain from the grading operation was also sent to secondary recovery.

The recovery of goods from the incoming elevator grain, as is basis, was as follows:

Refined Sorghum Grits for Food Applications: — 2772 lbs/hr or 52.0%

Materials to Secondary Recovery System: — 1322 lbs/hr or 24.8%

Grain Sorghum Mill Feed: — 1023 lbs/hr or 19.2%

Moisture Loss: — 133 lbs/hr or 2.5%

Cumulative Milling Loss: — 80 lbs/hr or 1.5%

The yield of the refined grits, based on the cleaned and graded gain and calculated on dry weights basis, was 58.0%.

EXAMPLE 2

A single unit of the apparatus of this diclosure was applied to the production of refined sorghum grits for food applications in accordance with the process flow illustrated by FIG. 10 of the drawing.

The incoming grain was of the same type and grade as that used in Example 1, and the manner of cleaning and grading was also the same as stated for the first example. In the case of Example 2, however, the grain was supplied to the cleaner at an inherent moisture content of 13.2 percent and at an average rate of 12,660 pounds per hour, and the average rate of removal of foreign matter and undersize grains by the cleaning and grading operations was 9.2 percent of the incoming grain, or 1160 pounds per hour. Thus, cleaned and graded grain was available to the milling operation at an average rate of 11,500 pounds per hour. This grain was delivered to a surge bin, which, from the primary feeder of the milling system, fed it at the controlled rate of 11,500 pounds per hour into a tempering auger.

The grain, entering the tempering auger at a moisture content of 12.8 percent, was conditioned by the addition of water near the grain inlet of the auger in an amount equal to 3 percent of the grain weight, and the rate of rotation of the auger and the level of moistened grain in the tempering bin were controlled to provide a tempering time of 6 minutes. As the grain was fed from the tempering bin into the apparatus of the invention by the screw feeder 39 thereof, a final increment of water equal to 0.5 percent of the weight of the grain was added by the spray arrangement 56 internal to the rotor 20, thereby remoistening the seedcoat tissue immediately prior to the entrance of the grain into the milling chamber wherein decortication and degermination were consummated.

The rotor 20 of the apparatus was driven at 640 rpm, the spreader 40 internal to the rotor was driven in the same direction of rotation at 1100 rpm, and the feed screw 39 was driven in the opposite direction of rotation at 325 rpm. The radial clearance between the outer edges of the rotor bars 29 and the inner edges of the stator bars 34 was 0.150 inch, and the perforations in the stator screen sections 35 were 0.109 inch diameter round. A flow of air was maintained through the apparatus at pressure slightly below atmospheric pressure to remove moisture and fine particles of material freed during the decortication and degermination of the grain.

After discharge through the rotary valve 54 of the apparatus, the admixture of milled grain particles was conveyed to and passed through a continuous dryer, as shown in FIG. 10, controlled to reduce the moisture content of the materials to 12.5 percent. The dried materials were sifted to remove particles finer than 30-mesh, and the coarser stock was then sifted to separate it into the two fractions: (1) over 12-mesh; and (2) between 12- and 30-mesh. Each of the two latter screening fractions was sent to an individual aspirator, each said aspirator being controlled to lift off the particles of germ and seedcoat tissues from its particular feedstock so as to produce grits of the required degree of refinement.

As in Example 1, the several offal fractions such as sifter and suction fines and cracked grains from the grading operation were distributed according to their compositions to secondary recovery and mill feed. The two separate grits streams were blended to constitute a single prime product.

For comparison to the results shown for Example 1, the recovery of goods from the incoming elevator grain supply, as is basis, was as follows:

Refined Sorghum Grits for Food Applications: — 7660 lbs/hr or 60.5%

Materials to Secondary Recovery System: — 2633 lbs/hr or 20.8%

Grain Sorghum Mill Feed: — 2127 lbs/hr or 16.8%

Moisture Loss: — 63 lbs/hr or 0.5%

Cumulative Milling Loss: — 177 lbs/hr or 1.4%

The yield of refined grits, based on the cleaned and graded grain and calculated on dry weight basis, was 67.2 percent as compared to 58.0 percent for Example 1. The grits produced in Examples 1 and 2 met the same specifications as to quality.

What we claim is:

1. In milling apparatus having an outer housing, having a cylindrical stator supported in said outer housing, said stator having a perforated peripheral wall and there being an outer space between said outer housing and stator from which grain particles are adapted to be discharged, having a rotor and having means supporting said rotor for rotation on a horizontal axis within said stator, there being a milling space between said rotor and stator, and there being cooperating means on the interior of the peripheral wall of the stator and the exterior of the rotor for performing concomitant decortication and degermination in said milling space, the improvement comprising having the rotor hollow and provided with openings in its periphery communicating with said milling space, and means for feeding grain into the interior of said hollow rotor to be discharged from said rotor openings into said milling space.

2. Milling apparatus as claimed in claim 1 in which there is means within the interior of the rotor for spreading the fed grain to cause distribution substantially throughout the length of the rotor.

3. Milling apparatus as claimed in claim 2 in which the openings in the periphery of the rotor are axially extending slots which extend substantially the length of said rotor.

4. Milling apparatus as claimed in claim 3 in which there is means on the interior of the rotor positioned between said slots for guiding grain toward the slots.

5. Milling apparatus as claimed in claim 4 in which said guiding means comprises ribs which are V-shaped in cross-section and which have sides which diverge toward the slots.

6. Milling apparatus as claimed in claim 1 in which the means for feeding grain into the interior of the hollow rotor includes a feed tube rotatable with the rotor and a reversely rotating feed screw within said feed tube.

7. Milling apparatus as claimed in claim 1 in which the means for feeding grain into the interior of the hollow rotor includes a feed tube having a flared discharge cone at its inner end positioned within the interior of the rotor and provided on the interior of its flared surface with means for separating and directing the discharge of grain.

8. Milling apparatus as claimed in claim 2 in which the means for spreading the grain includes a rotatable spreader having circumferentially spaced peripheral vanes disposed at angles to cause spreading.

9. Milling apparatus as claimed in claim 8 in which there is means for causing rotation of the spreader independently of the rotor.

10. Milling apparatus as claimed in claim 8 in which the means for feeding grain into the interior of the rotor includes a feed tube having its inner end positioned to discharge the grain in a location where it is acted upon by said spreader.

11. Milling apparatus as claimed in claim 10 in which the spreader includes spaced rotatable discs, and in which the inner end of the feed tube is positioned to discharge into said space, and in which the vanes are supported by the peripheries of said discs in positions to act on grain discharged centrifugally from the space between the discs.

12. Milling apparatus as claimed in claim 1 in which there is a drive shaft for the rotor having a bore which communicates with the interior of the rotor, in which there is a spreader within the rotor, and in which there is a drive shaft for the spreader which is rotatable in the bore of the rotor drive shaft.

13. Milling apparatus as claimed in claim 12 in which there is spray means adjacent the spreader, and in which the spreader drive shaft has a liquid duct leading to said spray means.

14. Milling apparatus as claimed in claim 11 in which there is liquid spray means carried by the spreader between the spaced rotatable discs for discharging liquid therebetween.

15. Milling apparatus as claimed in claim 1 in which there is a drive shaft for the rotor which is journaled in said housing and stator and connected to one end of the rotor, in which there is a hollow tail shaft journaled in the housing and stator and connected to the other end of the rotor and in communication with the interior thereof, and in which the means for feeding grain into the rotor includes said hollow tail shaft.

16. Milling apparatus as claimed in claim 15 in which there is a rotary grain spreader within the rotor, and in which there is a drive shaft for the spreader which is rotatably supported within the rotor for rotation independently thereof.

* * * * *